US005666143A

United States Patent [19]

Burke et al.

[11] Patent Number: 5,666,143

[45] Date of Patent: Sep. 9, 1997

[54] INKJET PRINTHEAD WITH TUNED FIRING CHAMBERS AND MULTIPLE INLETS

[75] Inventors: Peter M. Burke, Corvallis; Timothy L. Weber, Shedd, both of Oreg.

[73] Assignee: Hewlett-Packard Company, Palo Alto, Calif.

[21] Appl. No.: 282,243

[22] Filed: Jul. 29, 1994

[51] Int. Cl.[6] ..... B41J 2/05

[52] U.S. Cl. ..... 347/65; 347/94

[58] Field of Search ..... 347/56, 64, 94, 347/65

[56] References Cited

U.S. PATENT DOCUMENTS

| | | | |
|---|---|---|---|
| 4,314,259 | 2/1982 | Cairns et al. | 346/75 |
| 4,502,060 | 2/1985 | Rankin et al. | 346/140 R |
| 4,528,577 | 7/1985 | Cloutier et al. | 346/140 R |
| 4,794,410 | 12/1988 | Taub et al. | 346/140 R |
| 4,882,595 | 11/1989 | Trueba et al. | 346/140 R |
| 4,937,597 | 6/1990 | Yasuhara et al. | 346/140 R |
| 4,963,882 | 10/1990 | Hickman | 346/1.1 |
| 5,387,314 | 2/1995 | Baughman et al. | 216/27 |
| 5,412,413 | 5/1995 | Sekiya et al. | 347/46 |

FOREIGN PATENT DOCUMENTS

| | | | |
|---|---|---|---|
| 0314486 | 10/1988 | European Pat. Off. | B41J 3/04 |
| 0314486 | 5/1989 | European Pat. Off. | 347/94 |
| 0479441 | 9/1991 | European Pat. Off. | B41J 3/14 |
| 0549211 | 12/1992 | European Pat. Off. | B41J 3/14 |
| 0549211A1 | 6/1994 | European Pat. Off. | B41J 2/14 |
| 0636481 | 7/1994 | European Pat. Off. | B41J 3/14 |
| 3705446 | 2/1987 | Germany | B41J 3/04 |
| 3705446 | 12/1987 | Germany | B41J 3/04 |
| 61-37438 | 2/1986 | Japan | B41J 3/04 |
| 61-37438A | 7/1986 | Japan | B41J 3/04 |
| 4-355146 | 12/1992 | Japan | 347/94 |

OTHER PUBLICATIONS

McCabe and Smith, "Unit Operations Of Chemical Engineering", 3rd. Edition, McGraw Hill, 1976, pp. 110–111.

*Primary Examiner*—John E. Barlow, Jr.
*Attorney, Agent, or Firm*—Raymond A. Jenski

[57] ABSTRACT

An inkjet printer printhead is coupled to an ink source and has a plurality of ink firing chambers dimensionally defined by a barrier layer disposed between a substrate and an orifice plate. Two ink feed channels are coupled to one ink firing chamber and are dimensionally defined, in part, by the barrier layer. One of these ink feed channels has a smoothly converging wide dimension inlet at the ink source and a narrow dimension outlet at the ink firing chamber. The other ink feed channel also has a converging wide dimension inlet at the ink source and a narrow dimension outlet at the ink firing chamber but has an "S" shaped wall contour to make it asymmetrical to the first ink feed channel. An island of the barrier layer separates one ink feed channel from the other ink feed channel serving the ink firing chamber. This island has an essentially flat wall surface disposed toward the ink firing chamber.

15 Claims, 6 Drawing Sheets

INKJET PRINTHEAD WITH TUNED FIRING CHAMBERS AND MULTIPLE INLETS

BACKGROUND OF THE INVENTION

The present invention is generally related to a printhead for an inkjet primer and more particularly related to the design of ink feed channels for the ink firing chambers within the printhead. The present invention is related to U.S. patent application Ser. No. 08/282,670 for "Reduced Cross talk Ink Jet Printer Printhead" filed on half of Gopalan Raman on the same date herewith.

Thermal inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Expulsion of the ink droplet in a conventional thermal inkjet printer is a result of rapid thermal heating of the ink to a temperature which exceeds the boiling point of the ink solvent and creates a gas phase bubble of ink. Each nozzle is coupled to a small unique ink firing chamber filled with ink and having an individually addressable heating element resistor thermally coupled to the ink. As the bubble nucleates and expands, it displaces a volume of ink which is forced out of the nozzle and deposited on the medium. The bubble then collapses and the displaced volume of ink is replenished from a larger ink reservoir by way of ink feed channels.

After the deactivation of the heater resistor and the expulsion of ink from the firing chamber, ink flows back into the firing chamber to fill the volume vacated by the ink which was expelled. It is desirable to have the ink refill the chamber as quickly as possible, thereby enabling very rapid firing of the nozzles of the printhead. Rapid firing of the nozzles, of course, results in high speed printing. A large open fluid coupling between the supply of ink and the ink firing chamber would fulfill the need for high speed refilling. However, in a practical printhead where a plurality of nozzles and firing chambers exist, such a large coupling would result not only in ink being forced from the nozzle which is being fired but also being forced via the ink feed supply route to neighboring ink firing chambers and their associated nozzles. This phenomenon is commonly referred to as crosstalk, and produces imprecisely defined characters in the printed output as a result of multiple nozzles ejecting ink when only one should be doing so. Thus, some form of buffering of the common ink source is necessary to prevent crosstalk between adjacent ink firing chambers is necessary. See, for example, U.S. Pat. No. 4,882,595.

Additionally, a problem which occasionally manifests itself in inkjet printheads is that of a blockage occurring in an ink feed channel. Microscopic particles can become lodged in the narrow ink feed channel which has been used in earlier designs and starve the ink firing chamber of ink. A single nozzle which does not fire an ink droplet when it is commanded to do so will leave a missing portion out of a printed character and will leave an unprinted band on the medium when a solid image is to be printed. This results in a poorer quality of printed matter, highly undesirable for an inkjet primer. To resolve this undesirable characteristic, others have suggested using spare or redundant nozzles to eject ink in place of the defective nozzle (see U.S. Pat. No. 4,963,882 and U.S. patent application Ser. No. 08/277,723 "Kedundant Nozzle Dot Matrix Printheads and Methods of Use", filed on behalf of David E. Hackleman on Jul. 20, 1994) or multiple inlets to the ink firing chamber.

It would be desirable, therefore, to realize an inkjet printhead having improved tolerance to particle blockage and increased print speed without crosstalk between neighboring ink firing chambers and nozzles.

SUMMARY OF THE INVENTION

An inkjet printer printhead is coupled to an ink source and has a plurality of ink firing chambers dimensionally bounded by a barrier layer disposed between a substrate and an orifice plate. At least two ink feed channels are coupled to one ink firing chamber and are dimensionally defined, in part, by the barrier layer. At least one of these ink feed channels has a wide dimension inlet at the ink source and a narrow dimension outlet at one of the plurality of ink firing chambers. An island of the barrier layer separates one ink feed channel from the other ink feed channel serving an ink firing chamber. This island has an essentially flat wall surface disposed toward the ink firing chamber.

DETAILED DESCRIPTION OF THE PREFERRED EMBODIMENTS

Figure 1:
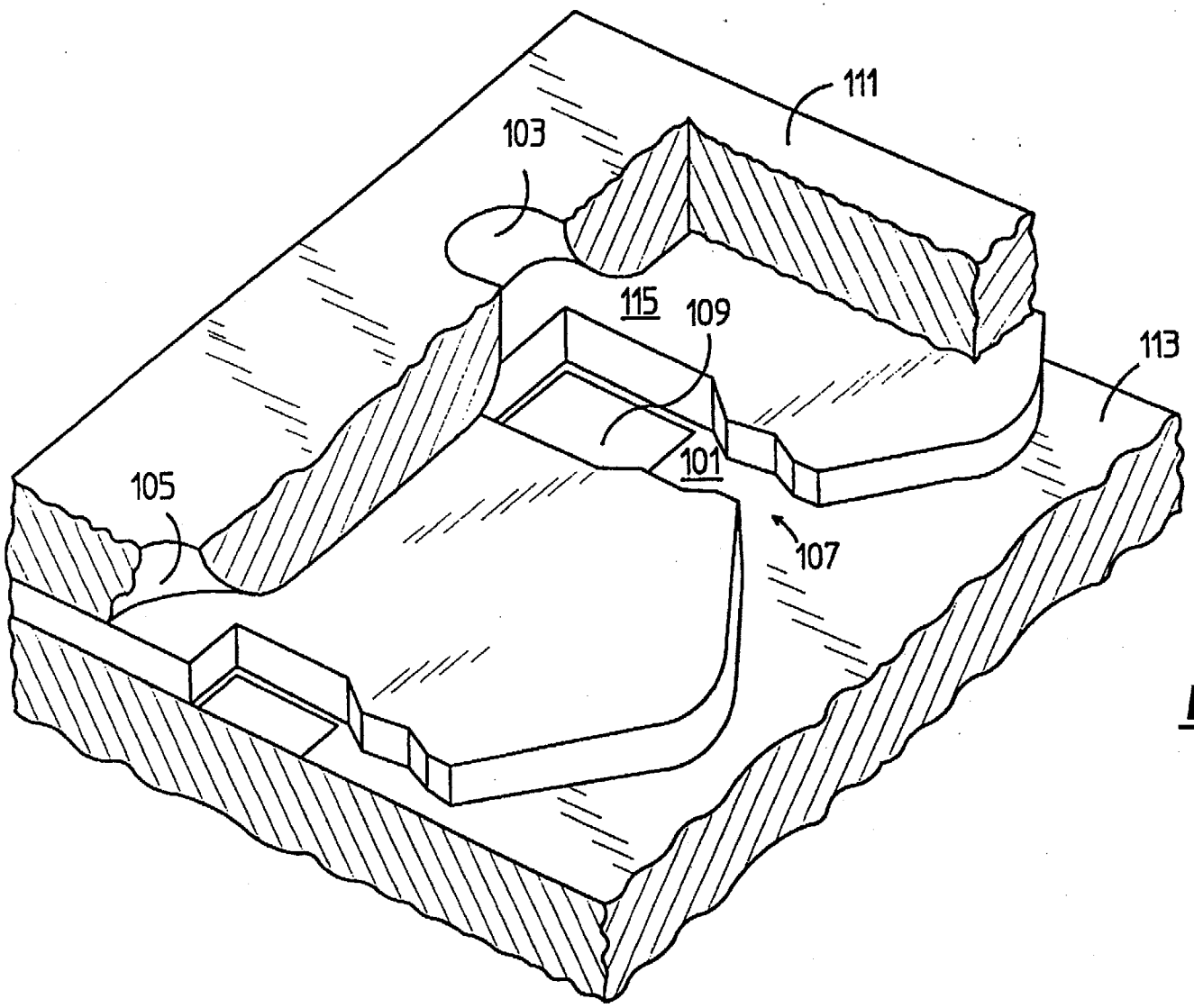
PRIOR ART FIG 1
FIG. 1 is an isometric view of an inkjet printer printhead.

A greatly magnified isometric view of a portion of a typical thermal inkjet printhead for use in an inkjet printer is shown in FIG. 1. Several elements of the printhead have been sectioned to reveal an ink firing chamber 101 within the inkjet printhead. Many such firing chambers are typically arranged in a staggered row in the printhead and two such rows can be arranged in a group around an ink supply plenum for efficient and high quality printing. Additional groups may be located it the printhead to allow for individual colors to be printed from each group. Associated with each firing chamber 101 is a nozzle 103 disposed relative to the firing chamber 101 so that ink which is rapidly heated in the firing chamber by a heater resistor 109 is forcibly expelled as a droplet from the nozzle 103. Part of a second nozzle 105, associated with another ink firing chamber is also shown. The heater resistors are selected by a microprocessor and associated circuitry in the printer in a pattern related to the data entered to the printer so that ink which is expelled from selected nozzles creates a defined character or figure of print on the medium. The medium (not shown) is typically held parallel to the orifice plate 111 and perpendicular to the direction of the ink droplet expelled from the nozzle 103. Ink is supplied to the firing chamber 101 via an opening 107 commonly called an ink feed channel. This ink is supplied to the ink feed channel 107 from a much larger ink reservoir (not shown) by way of an ink plenum which is common to all firing chambers in a group.

Once the ink is in the firing chamber 101 it remains there until it is rapidly heated to boiling by the heater resistor 109. Conventionally, the heater resistor 109 is a thin film resistance structure disposed on the surface of a silicon substrate 113 and connected to electronic circuitry of the printer by way of conductors disposed on the substrate 113. Printheads having increased complexity typically have some portion of the electronic circuitry constructed in integrated circuit form on the silicon substrate 113. Various layers of protection such as passivation layers and cavitation barrier layers may further cover the heater resistor 109 to protect it from corrosive and abrasive characteristics of the ink. Thus, the ink firing chamber 101 is bounded on one side by the silicon substrate 113 with its heater resistor 109 and other layers, and bounded on the other side by the orifice plate. 111 with its attendant orifice 103. The other sides of the firing chamber 101 and the ink feed channel 107 are defined by a polymer barrier layer 115. This barrier layer is preferably made of an organic polymer plastic which is substantially inert to the corrosive action of ink and is conventionally deposited upon substrate 113 and its various protective layers and is subsequently photolithographically defined into desired geometric shapes and etched. Polymers suitable for the purpose of forming a barrier layer 115 include products sold under the names Parad, Vacrel, and Riston by E. I. DuPont De Nemours and Company of Wilmington, Del. Such materials can withstand temperatures as high as 300 degrees C. and have good adhesive properties for holding the orifice plate of the printhead in position. Typically the barrier layer 115 has a thickness of about 25 to 30 micrometers after the printhead is assembled with the orifice plate 111.

The orifice plate 111 is secured to the silicon substrate 113 by the barrier layer 115. Typically the orifice plate 111 is constructed of nickel with a plating of gold to resist the corrosive effects of the ink. Typically the diameter of an orifice 103 in the orifice plate 111 is approximately 43 micrometers.

Figure 2:
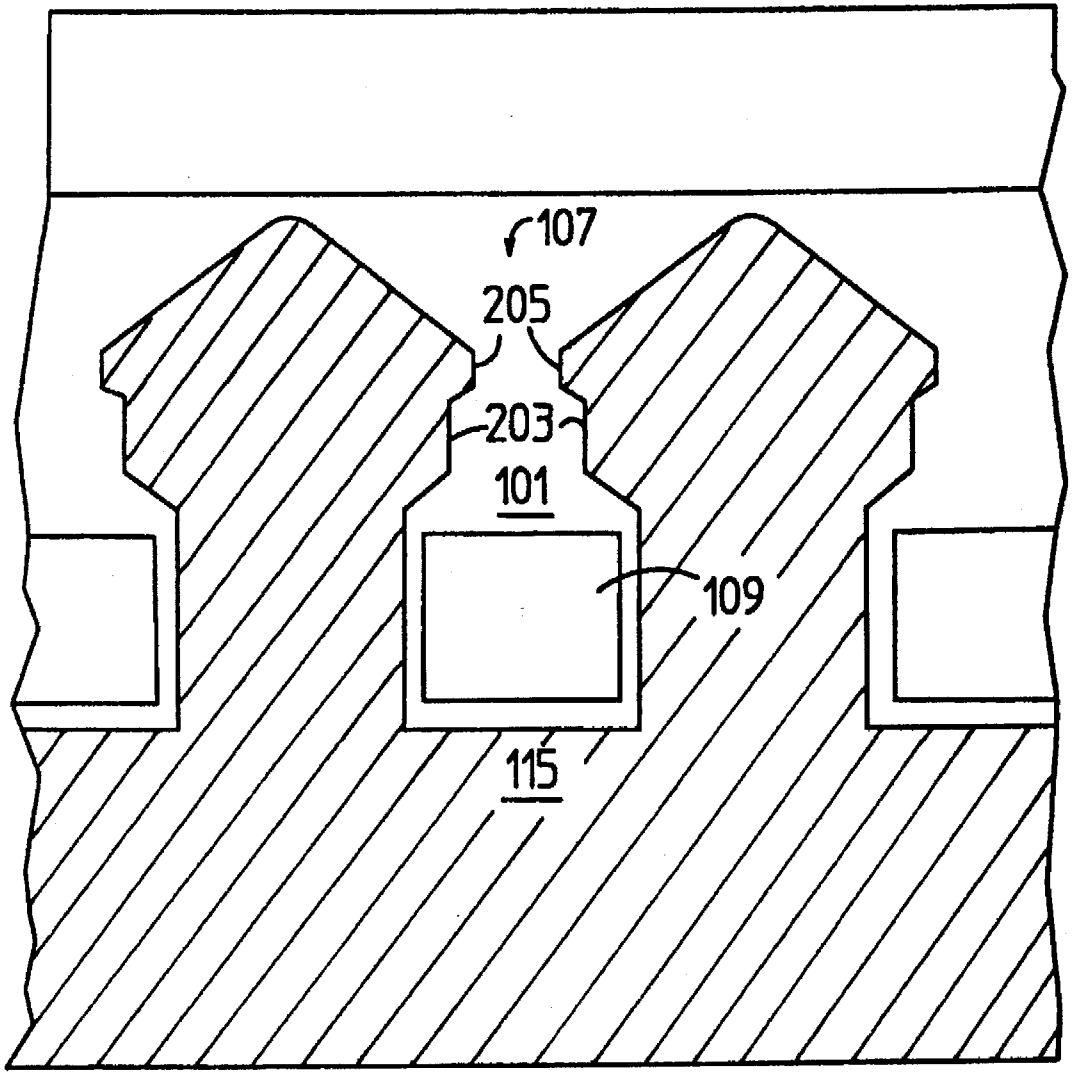
PRIOR ART FIG 2
FIG. 2 is a planar view of the barrier layer and substrate of the printhead of FIG. 1.

A plan view of the barber material in a conventional printhead of FIG. 1 is shown in FIG. 2. The heater resistor 109 is disposed in the firing chamber 101 and ink is supplied via the ink feed channel 107. In order to dampen the flow of ink back toward the ink source, the ink feed channel 107 has been given a series of constrictions 203 and 205 of decreasing channel width and dependent upon the distance from the heater resistor 109. Such a configuration has been found to provide satisfactory isolation and diminished crosstalk but at the cost of firing chamber ink refill speed.

Figure 3:
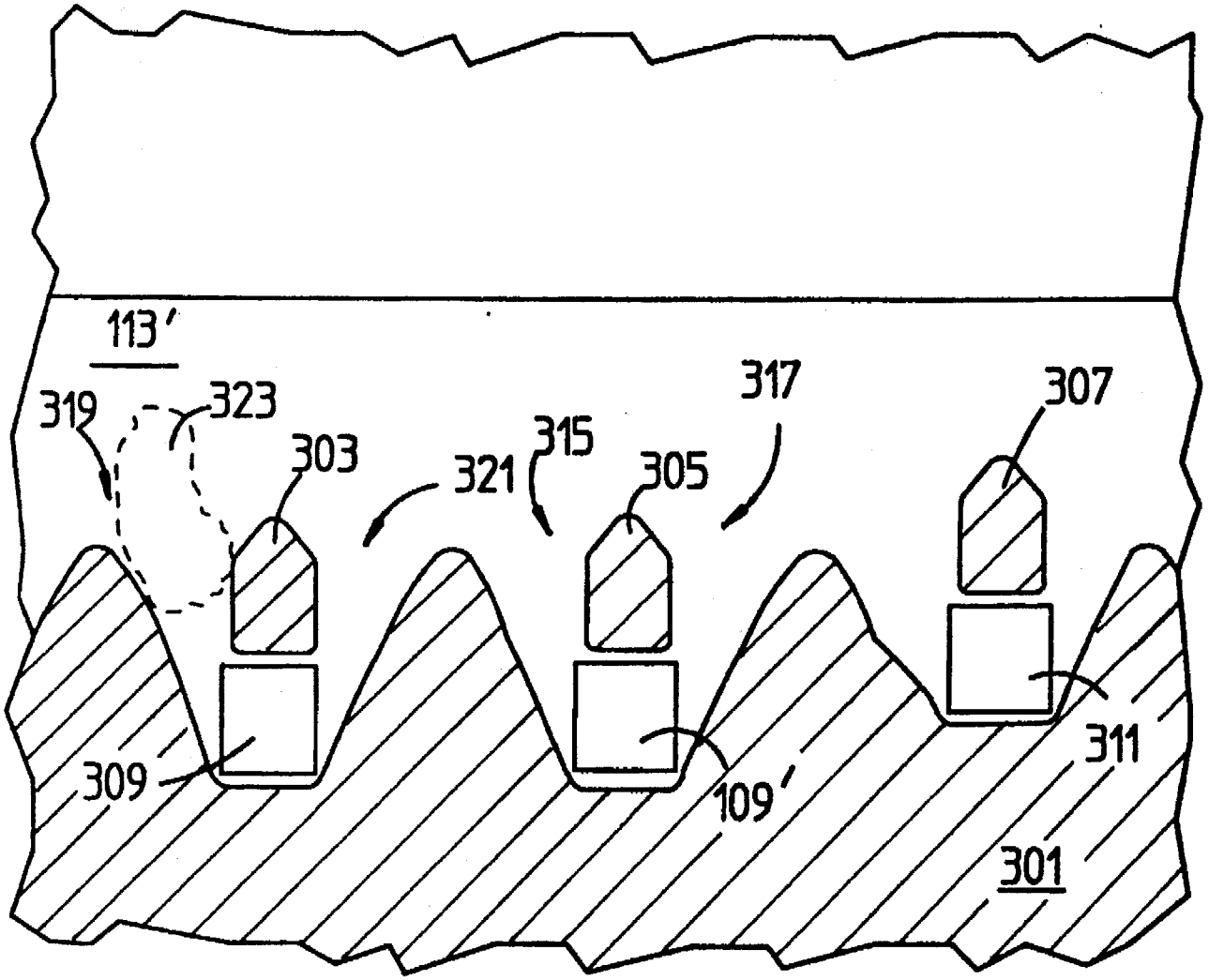
FIG. 3 is a planar view of the barrier layer and substrate of a printhead which may employ the present invention.
Figure 4:
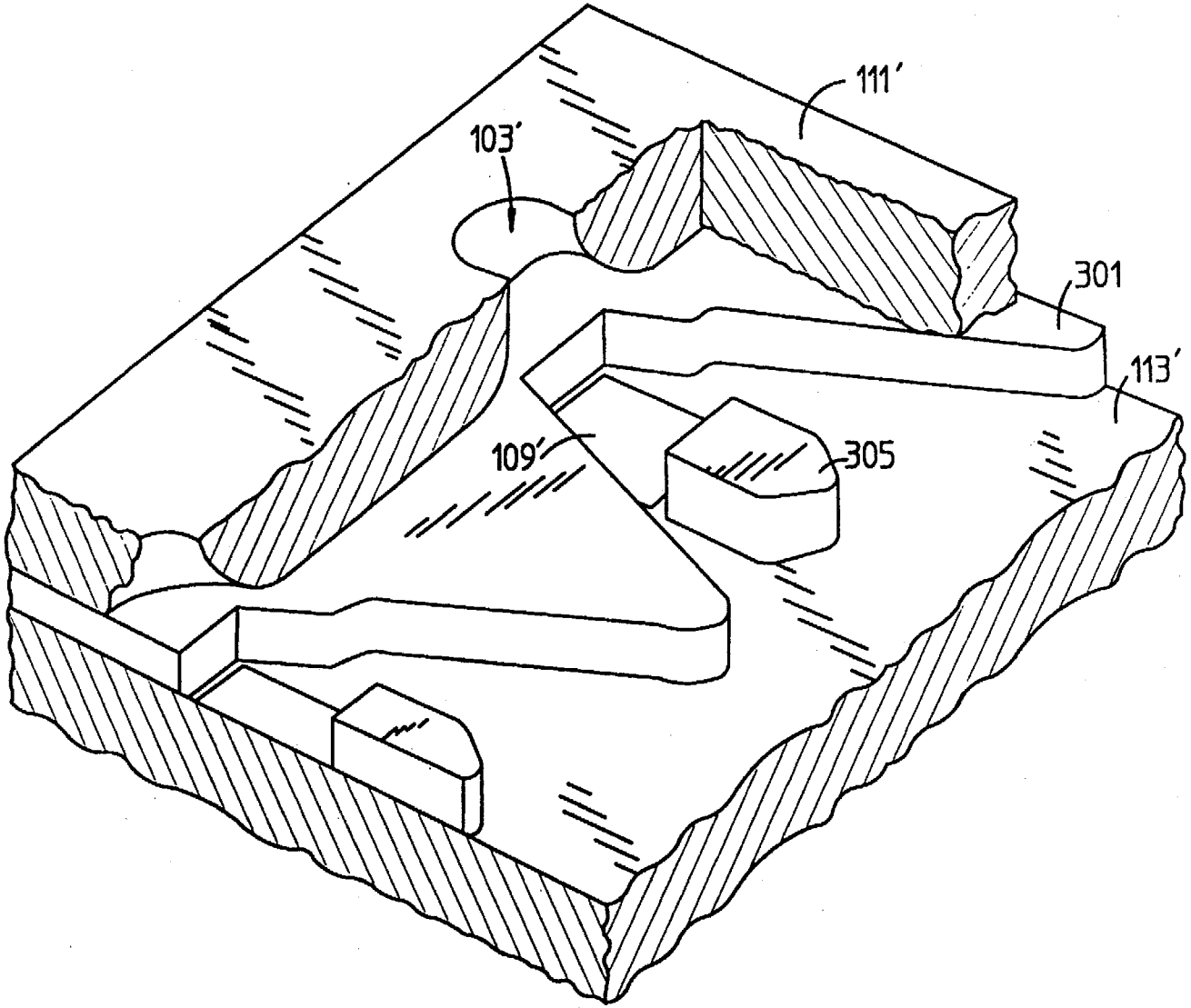
FIG. 4 is an isometric view of an inkjet printer printhead which may employ the present invention.

In order to realize an increased tolerance to particle blockage and increased print speed, the barrier material configuration for the ink feed channels and ink firing chambers has been tuned in accordance with the present invention. A plan view of the barrier layer material of a preferred embodiment of the present invention is shown in FIG. 3. An isometric view of the preferred embodiment is shown in FIG. 4. A layer of polymer barrier material 301 is conventionally deposited upon the silicon substrate 113'. As part of the polymer material etching process, a series of barrier material islands 303, 305, and 307 are created upon the silicon substrate 113'. (Resistors 109', 309, and 311 are conventionally created from thin film resistance material on the silicon substrate 113'). In the preferred embodiment the heater resistors are offset from one another and deviate from a straight line column to conventionally account for timing logic and common interconnection.

The barrier material islands 303, 305, and 307 are disposed between the heater resistors and the source of ink as shown in FIG. 3. This configuration effectively creates two ink channels, for example ink channels 315 and 317 associated with barrier material island 305 and ink channels 319 and 321 associated with barrier material island 303. Such an arrangement of two ink channels provides a redundancy of ink feed for each firing resistor. Should an undesirable particle 323 block one ink feed channel 319, the second ink feed channel 321 continues to provide an adequate ink supply to the firing chamber such that printing may continue in an acceptable fashion. Furthermore, a second ink feed channel often enables the ink pulse produced upon activation of the resistor to dislodge the undesirable particle from the blocked ink feed channel. Dual channel architecture gives approximately a one thousand fold increase in particle tolerance over a single channel architecture. If there is a 5% chance of having an ink feed channel blocked by a single particle, the chance of having two ink feed channels blocked by two particles is $(0.05)^2$. For a dual channel architecture in a 50 nozzle printhead, the chance of having two particles lodged in the dual ink feed channels of the same nozzle/firing chamber is $(0.05)^2/50$. This is an improvement factor over the single ink feed channel architecture of 1000. As can be expected, this ratio improves for smaller probabilities of lodgement of a single particle.

Figure 5:
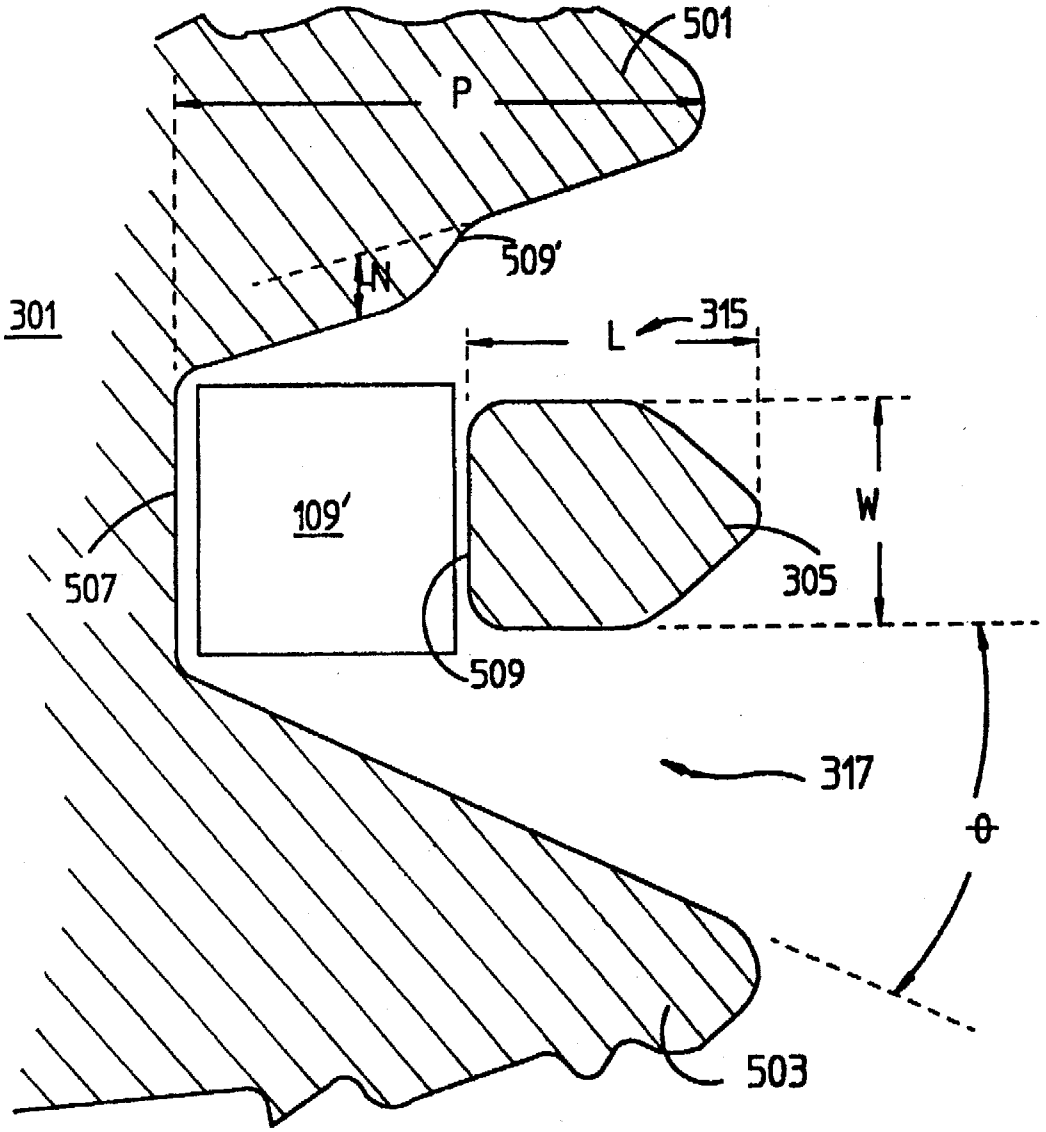
FIG. 5 is a planar view of the barrier layer and substrate of a printhead which may employ the present invention.

Additional features of the present invention can be perceived from the plan view of one firing chamber as shown in FIG. 5. The firing chamber containing resistor 109' is defined by barrier material walls created by protrusions 501 and 503 which come together in a truncated "V" shaped configuration. This truncation creates an end wall 507 which joins the walls formed by protrusions 501 and 503 to define a pocket for the heater resistor 109'. The front wall 509 of the ink firing chamber is defined by the end of barrier material island 305 which is closest to the heater resister 109' and, in the preferred embodiment, is an essentially flat wall forming a blunt end of the barrier material island 305. Conventionally, the floor and ceiling of the firing chamber are defined by the substrate and the orifice plate, respectively. Ink flows into an inlet of each of the ink feed channels 315 and 317 which each have a convergent aperture through which the ink must flow in order to reach the outlet of the ink feed channels into the ink firing chamber. It is an important feature of the present invention that the walls of the ink feed channels are not parallel but converge from the inlet to the outlet as the ink flows from the ink source to the firing chamber. Such convergent ink feed channel walls allow the ink to flow smoothly and with little drag resistance into the ink firing chamber. Also, the ink feed channels blend smoothly into the boundary walls forming the sides of the ink firing chamber.

When electrical energy is applied to the heater resistor 109', an ink vapor bubble is formed in the ink firing chamber above the heater resistor 109'. The rapid formation of this ink vapor bubble, in addition to ejecting ink through the nozzle 103', also forces ink backwards into the ink feed channels 315 and 317. Ink flowing in this backwards direction encounters divergent ink feed channel walls arranged such that the formation of vortices along the diverging walls is encouraged. These vortices exert a high drag resistance to the ink attempting to flow in this direction through the ink feed channels. Furthermore, some of the ink mass is captured in the vortex flow, itself, thereby transferring the translational momentum of the ink to a rotational momentum of the ink which was forced out of the ink firing chamber. Thus, the displaced ink in the printhead remains closer to the firing resistor 109' than in previous designs. The configuration of the preferred embodiment, then, is one in which ink may readily flow into the ink firing chamber but experiences a resistance to its flow out of the ink firing chamber by way of the ink feed channels. This configuration results in a higher rate of available printing since the ink firing chamber is not starved for ink.

In the preferred embodiment, each ink feed channel (for example ink feed channel 317) have divergent walls which diverge from each other at an angle θ, where θ is in the range of 15 to 45 degrees with a preferred angle of 30 degrees. The barrier material island 305, in the preferred embodiment, is essentially teardrop shaped, with the blunt end forming one wall of the firing chamber and the tail end facing the ink feed supply. In the preferred embodiment the barrier material island 305 has a length, L, of 60 micrometers and a width, W, of 41.5 micrometers. Barrier material island 305 is placed essentially in the center between the two ink feed channels 315 and 317, approximately 6 micrometers from the end wall 507 at the vertex of the firing chamber, Protrusions 501 and 503 extend into the common ink feed area for a distance of P micrometers from the back wall 507 of the ink firing chamber and have a rounded end with a radius of 12 micrometers. Since the heater resistor 109' may be staggered in the row of firing resistors, the distance, P, which the protrusions extend into the common ink feed supply range from 118 to 138 micrometers. Dimensions of the ink feed channels were made in conjunction with a simple hydraulic flow resistance model in which the resistance to the flow is proportional to the channel length divided by its area. In the preferred embodiment, the channel length is 60 micrometers and the channel width, at its narrowest point, is 34 micrometers for each ink feed channel. This configuration yields a doubling of hydraulic resistance for ink flowing out of the ink firing chamber relative to that of ink flowing into the firing chamber.

After the ink vapor bubble nucleation event, ink flows back into the firing chamber. It has been observed that the shape of the barrier material island 305, among other things, can discourage the coherent flow of ink back into the firing chamber. In the absence of the present invention, ink returning to the ink firing chamber by way of ink feed Channels 315 and 317 would combine in a coherent pressure wave at the junction of the two channels. The pressure wave would then propagate to the back wall 507 of the firing chamber hitting with enough force to produce an undesirable spray from the orifice 103'. Providing a blunt wall 509 at the barrier material island 305 interior surface causes some of the momentum of the ink returning via the two ink feed channels 315 and 317 to be directed against each other thereby canceling and preventing the formation of at least part of the coherent pressure wave.

Another feature of the present invention is that of producing an asymmetry between the walls of the two ink feed channels. In the preferred embodiment, a curvature 509 is introduced into the ink feed channel wall of ink feed channel 315. This curvature 509 is in the form of an "S" shaped narrowing such that the ink feed channel 315, in the area close to heater resistor 109' is reduced by an amount, N, which is equal to 5 micrometers. This asymmetry in the walls of the ink feed channels further disrupts the formation of a coherent pressure wave in the ink feed channel and prevents spray from being emitted from nozzle 103'.

Figure 6:
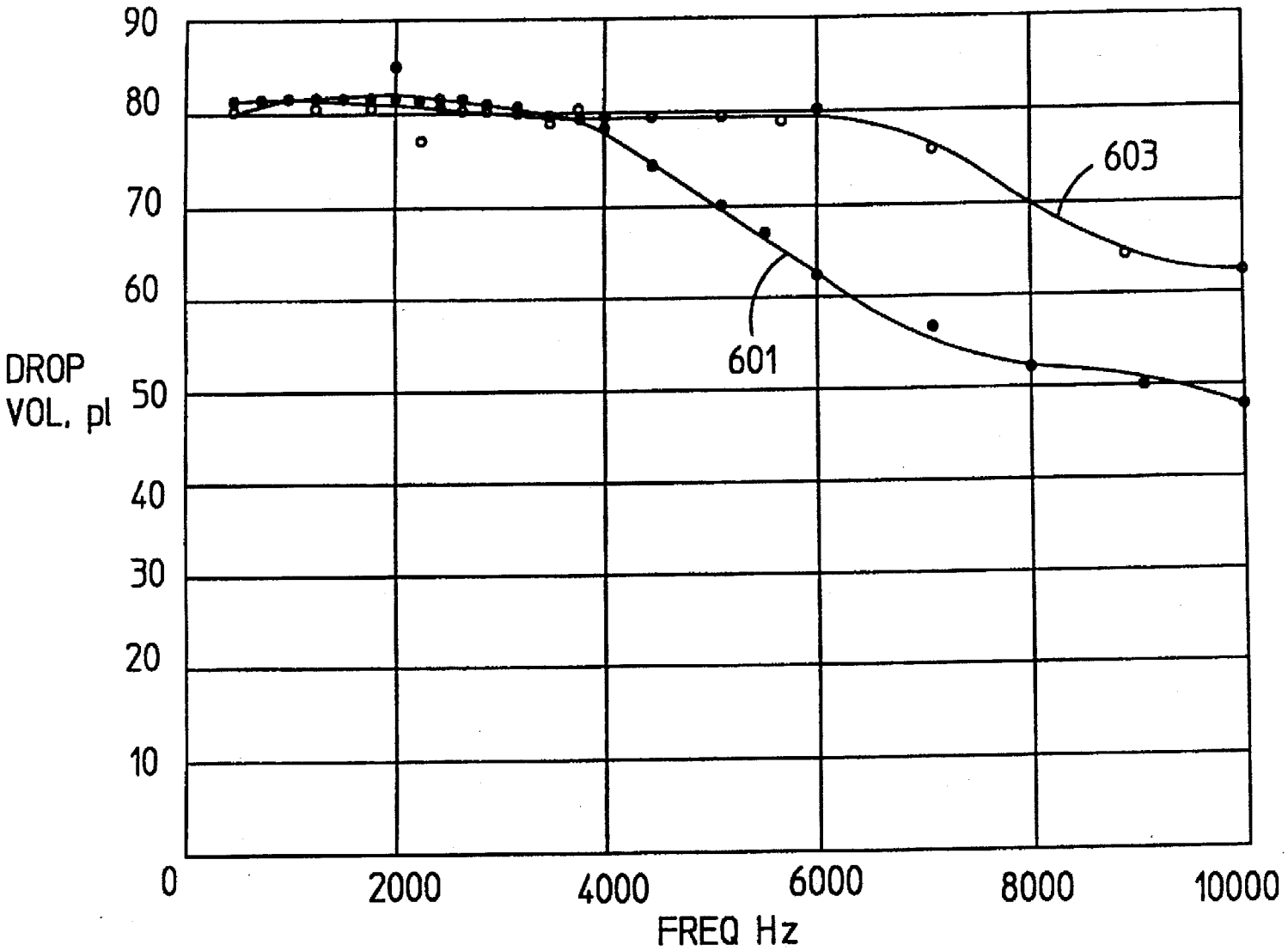
FIG. 6 is a graph of ink droplet volume versus the frequency of printhead nozzle expulsions and related to the present invention.

The performance improvement of a printhead employing the present invention can be perceived from the graph of FIG. 6. In FIG. 6, the volume of the ink droplet which is emitted from the nozzle during a print cycle is plotted against the rate (frequencies) at which the printhead nozzles are fired. Curve 601 illustrates the fact that the volume of the droplets begins to diminish when the nozzles are fired at a rate of approximately 4,000 Hz. This is primarily due to the fact that the heater resistor is caused to heat before the firing chamber has had a chance to totally refill, thus reducing the available ink and substantially reducing the ink droplet size. A printhead employing the present invention yields a performance curve such as that shown as curve 603 which illustrates that the ink droplet volume remains relatively constant until approximately 7,000 Hz. of nozzle firing frequency.

Furthermore, with the asymmetric walls of the ink feed channels and the blunt ended barrier material island undesirable spray from the nozzles is is maintained within acceptable limits.

We claim:

1. An inkjet printer printhead coupled to an ink source and having a plurality of ink firing chambers dimensionally bounded by a barrier layer disposed between a substrate and an orifice plate, comprising:

at least two ink feed channels coupled to one of the plurality of ink firing chamber and dimensionally defined, in part, by first and second walls of the barrier layer, at least a first one of said ink feed channels having said first wall of said at least two walls disposed non-parallel to said second wall to provide a wide dimension inlet at the ink source and a narrow dimension outlet at said one of the plurality of ink firing chambers; and an island of the barrier layer separating said first ink feed channel and a second ink feed channel of said at least two ink feed channels, said island having an essentially flat wall surface disposed toward the ink firing chamber.

2. An inkjet printer printhead in accordance with claim 1 wherein said essentially flat wall surface of said island further comprises at least part of the ink firing chamber dimensional boundary.

3. An inkjet printer printhead in accordance with claim 1 wherein said first and second walls further comprise two non-parallel walls which smoothly converge from said inlet to said outlet.

4. An inkjet printer printhead in accordance with claim 3 wherein said smoothly converging first and second walls converge at an angle of less than 45 degrees but greater than 15 degrees.

5. An inkjet printer printhead in accordance with claim 1 wherein said first one of said ink feed channels and said second one of said ink feed channels both comprise a wide dimension inlet at the ink source and a narrow dimension outlet at one of the plurality of ink firing chambers.

6. An inkjet printer printhead in accordance with claim 5 wherein said first and second ink feed chambers further comprise a convergence in an essentially truncated "V" shaped contour to form at least a part of the ink firing chamber dimensional boundary.

7. A method of increasing the operating frequency of and reducing the number of blocked ink feed channels in an inkjet printer printhead which has an ink source and at least one ink firing chamber with a plurality of walls forming the boundary of the ink firing chamber, the method comprising the steps of:

coupling, via at least two ink feed channels, the ink firing chambers to the ink source;

creating at least one of said convergent ink feed channels having first and second walls and with an inlet at said ink source and an outlet of said ink firing chamber, said first wall disposed non-parallel to said second wall whereby said at least one ink feed channel inlet is provided a larger dimension than said ink feed channel outlet; and placing an island between said at least two ink feed channels and at a first end of said ink firing chamber and disposing an essentially flat contour of said island toward the ink firing chamber whereby said essentially flat contour forms one boundary wall of the ink firing chamber.

8. A method in accordance with the method of claim 7 wherein said step of creating at least one convergent ink feed channel further comprises the step of smoothly converging said first and second non-parallel walls from said inlet to said outlet.

9. A method in accordance with the method of claim 8 wherein said step of smoothly converging said first find second walls further comprises the step of smoothly converging said first and second walls with an angle of converge less of less than 45 degrees but greater than 15 degrees.

10. A method of constructing in inkjet printer printhead by creating a plurality of ink firing chambers from a barrier layer disposed between a substrate and an orifice plate, comprising the steps of:

creating at least two ink feed channels from the barrier layer, each of said at least two ink feed channels having first and second non-parallel walls and an inlet and an outlet;

coupling at least a first one of said at least two ink feed channels from an inlet at the ink source with a wide separation between said first and second walls at said inlet to an outlet at the ink firing chamber with a narrow separation between said first and second walls at said outlet;

separating said first one of said at least two ink feed channels from a second one of said at least two ink feed channels with an island of the barrier layer; and creating one of the walls of the ink firing chamber with an essentially flat contour of said island disposed toward the ink firing chamber.

11. A method in accordance with the method of claim 10 wherein said step of coupling at least a first one of said at least two ink feed channels further comprises the step of smoothly converging said first and second walls from said inlet to said outlet.

12. A method in accordance with the method of claim 11 wherein said step of smoothly converging said first and second walls further comprises the step of smoothly converging said first and second walls with an angle of convergence of less than 45 degrees but greater than 15 degrees.

13. An inkjet printer printhead coupled to an ink source and having a plurality of ink firing chambers dimensionally bounded by a barrier layer disposed between a substrate and an orifice plate, comprising:

at least two ink feed channels coupled to one of the plurality of ink firing chambers and dimensionally defined, in part, by the barrier layer, at least a first one of said ink feed channels having a wide dimension inlet at the ink source and a narrow dimension outlet at said one of the plurality of ink firing chambers and having one wall of said first one of said ink feed channels formed of the barrier layer and having an essentially "S" shaped contour; and an island of the barrier layer separating said first ink feed channel and a second ink feed channel of said at least two ink feed channels, said island having an essentially flat wall surface disposed toward the ink firing chamber.

14. A method of increasing the operating frequency of and reducing the number of blocked ink feed channels in an inkjet printer printhead which has an ink source and at least one ink firing chamber with a plurality of walls forming the boundary of the ink firing chamber, the method comprising the steps of:

coupling, via at least two ink feed channels, the ink firing chamber to the ink source;

creating at least one of said convergent ink feed channels with an inlet at said ink source and an outlet at said ink firing chamber and forming a wall of said at least one ink feed channel with an essentially "S" shaped contour, said at least one ink feed channel inlet having a larger dimension than said ink feed channel outlet; and placing an island between said at least two ink feed channels and at a first end of said ink firing chamber and disposing an essentially flat contour of said island toward the ink firing chamber whereby said essentially flat contour forms one boundary wall of the ink firing chamber.

15. A method of constructing an inkjet printer printhead by creating a plurality of ink firing chambers from a barrier layer disposed between a substrate and an orifice plate, comprising the steps of:

creating at least two ink feed channels from the barrier layer, each of said at least two ink feed channels having an inlet and an outlet;

coupling at least a first one of said at least two ink feed channels from an inlet at the ink source with a wide inlet dimensino to an outle at the ink firing chamber with a narrow outlet dimension;

forming a wall of said at least two ink feed channels with an essentially "S" shaped contour;

separating said first one of said at least two feed channels from a second one of said at least two ink feed channels with an island of the barrier layer; and creating one of the walls of the ink firing chamber with an essentially flat contour of said island disposed toward the ink firing chamber.

* * * * *

UNITED STATES PATENT AND TRADEMARK OFFICE

CERTIFICATE OF CORRECTION

PATENT NO. : 5,666,143
DATED : September 9, 1997
INVENTOR(S) : Peter M. Burke et al.

It is certified that error appears in the above-identified patent and that said Letters Patent is hereby corrected as shown below:

Column 1,
Line 11, replace the word "half" with the word -- behalf --.

Column 3,
Line 45, replace the word "barber" with the word -- barrier --.
Line 48, replace the word "dimensino" with the word -- dimension -- and the word "outle" with the word -- outlet --.

Signed and Sealed this

Fifth Day of November, 2002

*Attest:*

*Attesting Officer*

JAMES E. ROGAN
*Director of the United States Patent and Trademark Office*